US010027092B2

(12) United States Patent
Burrows et al.

(10) Patent No.: US 10,027,092 B2
(45) **Date of Patent: *Jul. 17, 2018**

(54) SPARK IGNITION DEVICE FOR AN INTERNAL COMBUSTION ENGINE AND CENTRAL ELECTRODE ASSEMBLY THEREFORE

(71) Applicant: Federal-Mogul Ignition Company, Southfield, MI (US)

(72) Inventors: John Burrows, Timperley (GB); Paul Tinwell, Fayence (FR); Robin Clarke, Little Leigh (GB)

(73) Assignee: Federal-Mogul Ignition Company, Southfield, MI (US)

( * ) Notice: Subject to any disclaimer, the term of this patent is extended or adjusted under 35 U.S.C. 154(b) by 420 days.

This patent is subject to a terminal disclaimer.

(21) Appl. No.: 14/223,216

(22) Filed: Mar. 24, 2014

(65) Prior Publication Data

US 2014/0202413 A1 Jul. 24, 2014

Related U.S. Application Data

(62) Division of application No. 12/638,597, filed on Dec. 15, 2009, now Pat. No. 8,707,922.

(51) Int. Cl.
*H01T 13/20* (2006.01)
*H01T 13/18* (2006.01)

(52) U.S. Cl.
CPC ..... *H01T 13/20* (2013.01); *H01T 13/18* (2013.01)

(58) Field of Classification Search
CPC ..... H01T 13/20; H01T 13/18
See application file for complete search history.

(56) References Cited

U.S. PATENT DOCUMENTS 1,293,520 A * 2/1919 Nolte ..... F23Q 7/001 123/145 A
1,364,262 A 1/1921 Faber
(Continued)

FOREIGN PATENT DOCUMENTS

CN 101132121 A 2/2008
GB 1384199 A 2/1975
(Continued)

*Primary Examiner* — David Hamaoui
(74) *Attorney, Agent, or Firm* — Robert L. Stearns; Dickinson Wright, PLLC

(57) ABSTRACT

A spark ignition device includes a ceramic insulator with a metal shell surrounding at least a portion of the ceramic insulator. A ground electrode is attached to the shell. The ground electrode has a ground electrode sparking tip spaced from a central sparking tip by a spark gap. A first terminal is arranged in electrical communication with the central sparking tip and is configured for electrical connection with a power source. The device further includes a second terminal configured for electrical connection with the power source. The second terminal is spaced from the first terminal, with the second terminal being arranged in electrical communication with the first terminal. A heater element brings the first terminal in electrical communication with the second terminal and completes an electrical circuit. The heater element has a resistance greater than the first and second terminals thereby producing a significant source of heat.

11 Claims, 7 Drawing Sheets

(56) References Cited

U.S. PATENT DOCUMENTS

| | | | | | |
|---|---|---|---|---|---|
| 1,662,724 | A | | 3/1928 | Tansil | |
| 1,667,960 | A | | 5/1928 | Theis | |
| 1,690,135 | A | | 11/1928 | Seekamp | |
| 1,784,541 | A | | 12/1930 | Rouillard | |
| 2,665,672 | A | | 1/1954 | Coughlin | |
| 3,087,980 | A | * | 4/1963 | Monnig | H01T 13/18 123/146.5 R |
| 3,348,091 | A | | 10/1967 | Abdella | |
| 3,589,348 | A | | 6/1971 | Reichhelm | |
| 3,680,538 | A | * | 8/1972 | Scherenberg | H01T 13/18 123/169 PB |
| 3,742,280 | A | | 6/1973 | Siegle | |
| 3,851,637 | A | * | 12/1974 | Green | H01T 13/18 123/145 A |
| 4,205,650 | A | | 6/1980 | Szwarchier | |
| 4,970,427 | A | | 11/1990 | Scharnweber et al. | |
| 5,044,331 | A | * | 9/1991 | Suga | F02D 41/064 123/169 PB |
| 5,109,817 | A | | 5/1992 | Cherry | |
| 6,060,821 | A | * | 5/2000 | Suzuki | H01T 21/02 123/169 EL |
| 8,707,922 | B2 | * | 4/2014 | Burrows | H01T 13/18 123/169 EL |

FOREIGN PATENT DOCUMENTS

| | | |
|---|---|---|
| GB | 2185529 A | 7/1987 |
| JP | 2278684 | 11/1990 |
| JP | 2278685 | 11/1990 |
| JP | 3055785 | 3/1991 |
| JP | 4017284 | 1/1992 |
| JP | 4022087 | 1/1992 |
| JP | 4022088 | 1/1992 |
| JP | 4058489 | 2/1992 |
| JP | 3075280 | 3/1992 |
| JP | 5258836 | 10/1993 |

* cited by examiner

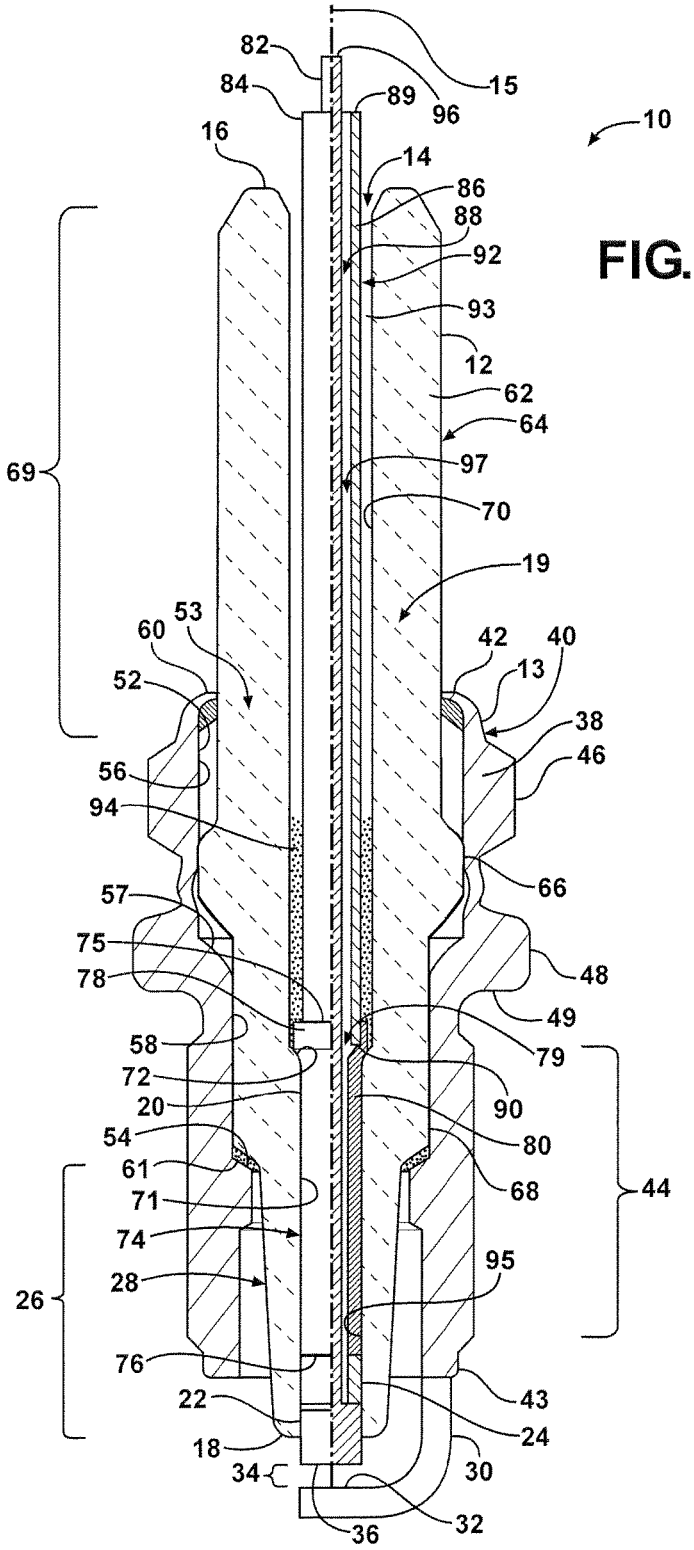
FIG. 2
FIG. 2A
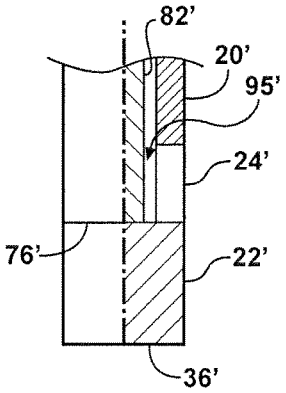

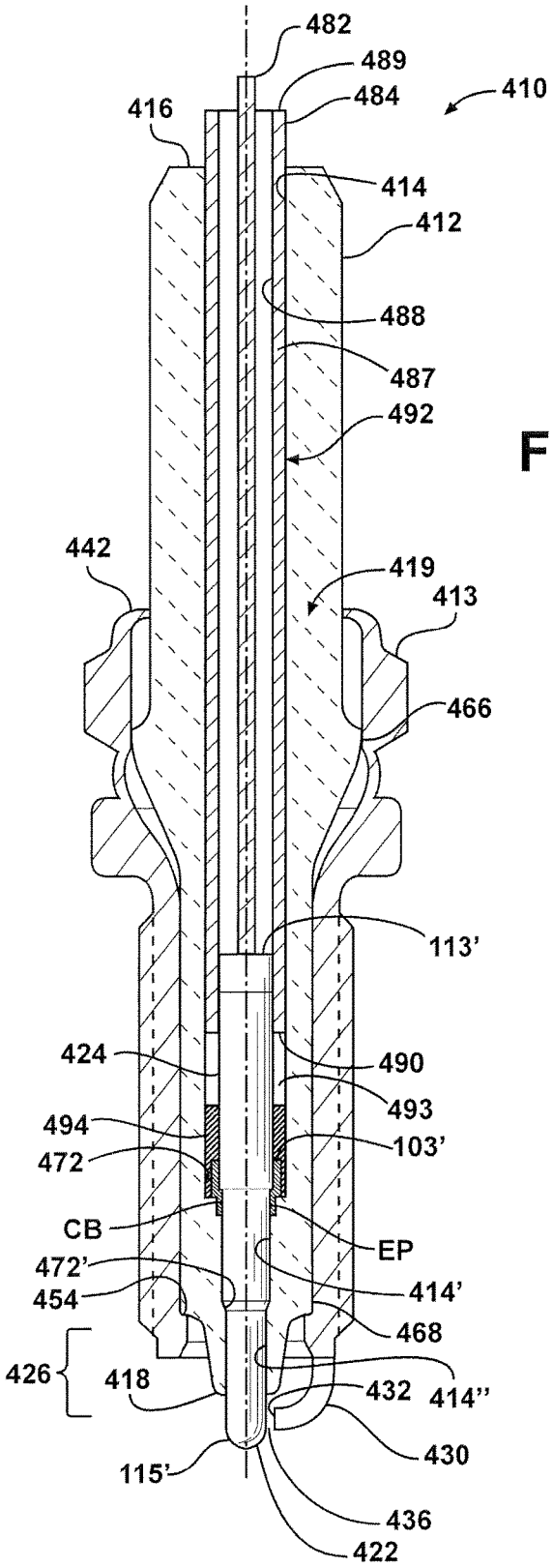
FIG. 6
FIG. 6A
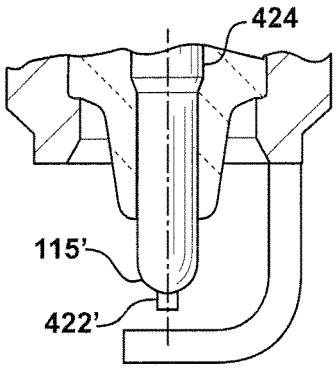

SPARK IGNITION DEVICE FOR AN INTERNAL COMBUSTION ENGINE AND CENTRAL ELECTRODE ASSEMBLY THEREFORE

CROSS REFERENCE TO RELATED APPLICATIONS

This Divisional Patent Application claims priority to U.S. Utility patent application Ser. No. 12/638,597, filed Dec. 15, 2009, which is incorporated herein by reference in its entirety.

BACKGROUND OF THE INVENTION

1. Technical Field

This invention relates generally to spark ignition devices, such as spark plugs for internal combustion engines, and more particularly to spark ignition devices having heater elements.

2. Related Art

In construction of an ignition device for an internal combustion engine, such as for a spark plug, a compromise generally needs to be made between selecting the operating heat range at which the spark plug will operate. On one hand, if the temperature selected is too hot, the spark plug will typically have a reduced life and can ultimately reduce the life of engine components. On the other hand, if the temperature selected is too cold, the spark plug may exhibit a tendency to become fouled via carbon deposits on an insulator of the spark plug, thereby resulting in reduced performance and ultimate failure of the spark plug. Accordingly, it is customary to try to design the spark plug to operate at the hottest temperature possible without greatly impacting the useful life of the spark plug or the engine components. However, this option is not without potential negative consequences in that these spark plugs typically do not operate optimally at cooler operating conditions.

Typically, conventional spark plugs, such as shown in the prior art FIG. 1, have a terminal 1 configured for attachment to a high voltage source. The high voltage travels through the terminal and then through one or more intermediate components to a central electrode 2. The high voltage is insulated from an outer metal shell 3 by an insulator 4. Upon sufficient high voltage reaching the center electrode, a spark jumps from the center electrode to a ground electrode 5 across a spark gap 6, causing ignition of flammable combustion gases. The high voltage current then flows to ground provided by the engine block (not shown) through a threaded region 7 and seat 8 of the metal shell 3 which are in contact with the engine block.

During continued use of the conventional spark plug described above, it is possible for contamination to build up on an exposed outer surface 9 of the insulator core nose which can provide an alternate path for electrical current flow from the central electrode 2. As such, rather than the electrical flow resulting in a spark across the gap 6, the electrical flow jumps directly from the central electrode 2 to the shell 3. This ultimately results in incomplete combustion and failure of the spark plug. Some efforts have been made to overcome the build up of contamination on the outer surface 9 of the core nose, thereby reducing fouling, by increasing the core nose length. The increased length of the core nose increases the operating temperature of the core nose by exposing it to the high operating temperature within the combustion chamber. The increased length core nose is also more resistant to fouling by increasing the distance over which the high voltage must travel. However, increasing the length of the core nose is not without tradeoffs. By extending the tip of the core nose closer to the high temperature within the combustion chamber, the heated core nose tip could inadvertently cause premature ignition of combustion gases within the combustion chamber. In addition, accelerated wear can result to the central electrode, as it must be extended beyond the tip of the extended core nose. Accordingly, continued efforts are made to provide spark plugs with an optimal performance over operating anticipated temperature ranges, while at the same time optimizing the useful life of the spark plugs and associated engine components.

SUMMARY OF THE INVENTION

A spark ignition device constructed in accordance with one aspect of the invention includes a tubular ceramic insulator extending along a central axis with a metal shell surrounding at least a portion of the ceramic insulator. Further, a ground electrode is operatively attached to the shell, with the ground electrode having a ground electrode sparking tip. Further yet, the device has a central sparking tip, wherein the central sparking tip and the ground electrode sparking tip provide a spark gap. A first terminal is arranged in electrical communication with the central sparking tip and is configured for electrical connection with a power source. The device further includes a second terminal configured for electrical connection with the power source. The second terminal is spaced from the first terminal, with the second terminal being arranged in electrical communication with the first terminal. Further, a heater element brings the first terminal in electrical communication with the second terminal and completes an electrical circuit between the first and second terminals, wherein the heater element has a resistance greater than the first and second terminals.

In accordance with another aspect of the invention, a central electrode assembly for a spark ignition device is provided. The central electrode assembly includes a first terminal arranged configured for electrical connection with a power source and a second terminal spaced from the first terminal and arranged in electrical communication with the first terminal and configured for electrical connection with the power source. Further, a heater element brings the first terminal in electrical communication with the second terminal and completes an electrical circuit between the first and second terminals.

BRIEF DESCRIPTION OF THE DRAWINGS

These and other aspects, features and advantages of the invention will become more readily appreciated when considered in connection with the following detailed description of presently preferred embodiments and best mode, appended claims and accompanying drawings, in which:

FIG. 2 is a cross-sectional elevation view of an ignition device having a heater element constructed in accordance with one aspect of the invention;

FIG. 2A is a partial cross-sectional elevation view taken generally in the encircled area 2A of FIG. 2 showing a firing end of an ignition device constructed in accordance with yet another aspect of the invention;

FIG. 6 is a cross-sectional elevation view of an ignition device having a heater element constructed in accordance with yet another aspect of the invention;

FIG. 6A is a partial cross-sectional elevation view taken generally in the encircled area 6A of FIG. 6 showing a firing end of an ignition device constructed in accordance with yet another aspect of the invention;

DETAILED DESCRIPTION

Figure 1:
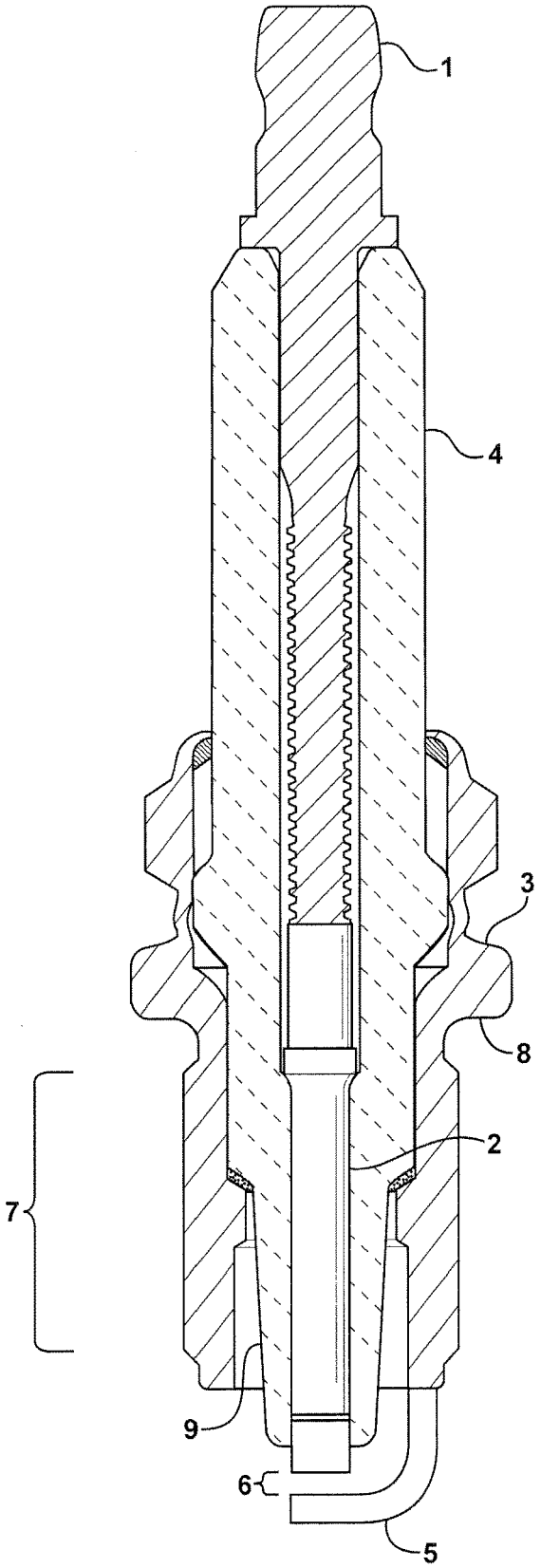
FIG. 1 Prior Art
FIG. 1 is a cross-sectional elevation view of a prior art ignition device.

Referring in more detail to the drawings, FIG. 2 illustrates a spark ignition device 10 constructed in accordance with one presently preferred aspect of the invention for use in igniting a fuel/air mixture in an internal combustion engine (not shown). The exemplary spark ignition device 10 is illustrated in the form of a spark plug, but the invention contemplates other ignition devices to be within the scope of the claims, such as glow plugs, for example. The device 10 includes an annular ceramic insulator 12 fabricated of aluminum oxide or another suitable electrically insulating material. The insulator 12 is captured at least in part in an electrically conductive metal shell 13. The insulator 12 has a central passage 14 extending axially along a central axis 15 between opposite ends, referred to hereafter as an upper terminal end 16 and a lower core end or core nose end 18. A central electrode assembly represented generally at 19 is disposed at least in part in the central passage 14. The central electrode assembly 19 includes, at least in part, a central electrode 20; a firing tip 22, and a heater element 24 disposed between the central electrode 20 and the firing tip 24. The heater element 24 is located adjacent the core nose end 18 and within a conical core nose region 26 of the insulator 12. During use, the heater element 24 is caused to increase in temperature, due to its having an increased resistivity relative to the central electrode 20 and the firing tip 22. As such, the heat generated substantially independent of the combustion heat by the heater element 24 is able to be transferred on precisely the desired area of the core nose region 26 to inhibit contamination build-up on an exposed outer surface 28 of the core nose region 26, thereby inhibiting the device 10 from becoming "fouled".

The metal shell 13 is disposed in sealed relation about lower and mid portions of the insulator 12 and may be made from any suitable metal, such as various steel alloys, and may be coated with Ni-base alloy coating or the like. The shell 13 includes at least one ground electrode 30 which may have any of a number of shapes, sizes and configurations, such as the standard single L-shaped configuration, as illustrated in the drawings, for example. The ground electrode 30 has at least one ground electrode sparking surface 32 that is spaced across a spark gap 34 from a sparking surface 36 of the firing tip 22. At least one of the sparking surfaces 32, 36 can be formed at least in part from at least one noble metal from the group consisting of platinum, iridium, palladium, rhodium, osmium, gold and silver, and may include more than one of these noble metals in combination (e.g., all manner of Pt—Ir alloys). The sparking surfaces 32, 36 may also comprise as an alloying constituent one or more metals from the group consisting of tungsten, yttrium, lanthanum, ruthenium and zirconium.

The shell 13 has a generally tubular body 38 with a generally annular outer surface 40 extending between an upper terminal end 42 and a lower fastening end 43. The fastening end 43 typically has an external threaded region 44 configured for threaded attachment within a combustion chamber opening of an engine block (not shown). The shell 13 may be provided with an external hexagonal tool receiving member 46 or other feature for removal and installation of the spark ignition device 10 in the combustion chamber opening. The shell 13 also has an annular flange 48 extending radially outwardly from the outer surface 40 to provide an annular, generally planar sealing seat 49 extending substantially transversely to the axis 15, from which the threaded region 44 depends. The sealing seat 49 forms a hot gas-tight seal of the space between the outer surface 40 of the shell 13 and the threaded bore in the combustion chamber opening. Alternately, a gasket (not shown) may be used in combination with the sealing seat 49 and/or the sealing seat 49 may be configured as a tapered seat (not shown) to provide a close tolerance and a self-sealing installation in a cylinder head which is also designed with a mating taper for this style of spark plug seat.

The tubular shell body 38 has an inner wall or surface 52 providing an open cavity 53 extending through the length of the shell between the terminal and fastening ends 42, 43. An internal lower flange 54 extends radially inwardly from the inner surface 52 adjacent the fastening end 43 to provide a stop surface for the insulator 12. The inner surface 52 has an enlarged diameter region 56 adjacent the terminal end 42 to accommodate an enlarged portion of the insulator 12. Accordingly, an annular shoulder 57 extends radially inwardly from the enlarged diameter region 56 to a reduced diameter region 58. The enlarged diameter region 56 extends upwardly from the shoulder 57 and has a substantially straight, cylindrical and constant diameter substantially to the terminal end 42. An upper lip 60 of the shell body 38 is curled radially inwardly in a crimping or roll curling process to capture the insulator 12 in the shell 13. Gaskets, cement, or other packing or sealing compounds can also be interposed between the lip 60 an the insulator 14 to perfect a gas-tight seal and to improve the structural integrity of the assembled spark ignition device 10, and further, a gasket 61 can be disposed between the lower flange 54 and the lower shoulder 68.

The insulator 12, which may include aluminum oxide or another suitable electrically insulating material having a specified dielectric strength, high mechanical strength, high thermal conductivity, and excellent resistance to thermal shock, may be press molded from a ceramic powder in a green state and then sintered at a high temperature sufficient to densify and sinter the ceramic powder. The insulator 12 has an elongate body 62 with an annular outer surface 64 extending between the upper terminal or proximal end 16 and the lower core nose or distal end 18. The body 62 has a lower portion with a large diameter annular upper shoulder 66 and a smaller diameter annular lower shoulder 68. An upper mast portion 69 extends upwardly from the upper shoulder 66 to which a rubber or other insulating spark plug boot (not shown) surrounds and grips to electrically isolate an electrical connection with an ignition wire and system (not shown). The mast portion 69 may include a series of ribs (not shown) or other surface glazing or features to provide added protection against spark or secondary voltage flash-over and to improve the gripping action of the mast portion 69 with the spark plug boot. The reduced diameter nose portion or core nose region 26 depends from the lower shoulder 68 to the distal end 18. The core nose region 26 typically has a slight taper converging toward the distal end 18, although other configurations, including a straight cylindrical shape are contemplated herein.

The insulator 12 is of generally annular, tubular construction, having the central through passage 14 extending longitudinally between the upper proximal end 16 and the lower distal end 18. The central passage 14 is represented here as having a varying cross-sectional area as taken transversely to the axis 15, with an increased diameter region 70 extending upwardly from generally adjacent the core nose region 26 to the proximal end 16, and a reduced diameter region 71 extending from the increased diameter region 70 to the distal end 18, with an annular shoulder 72 extending generally radially between the respective regions 70, 71.

The central electrode 20 of the central electrode assembly 19 may have any suitable external shape, and is represented here, by way of example and without limitation, as having a body with a cylindrical or substantially cylindrical outer surface 74 extending generally between an upper terminal end 75 and a lower distal end 76, and having a radially outward arcuate flair or taper to an increased diameter head 78 at the terminal end 75. The annular head 78 facilitates seating and sealing the terminal end 75 within the insulator 12 against the shoulder 72. The central electrode body is tubular in construction, and thus, has a central through passage 79 provided by an outer tubular wall 80 extending between the terminal and distal ends 75, 76. The central electrode 20 is constructed from any suitable conductor material having good thermal and electrical conductivity and an ability to withstand the combustion environment, such as various Ni and Ni-based alloys, for example, and may also include such materials clad over a Cu or Cu-based alloy core, for example.

The central electrode assembly 19 includes a first terminal, also referred to as a central or inner terminal 82 and a second terminal, also referred to as an outer terminal 84. The second terminal 84, as shown in the embodiment of FIG. 2, by way of example and without limitation, is constructed, at least in part, by a tubular body 86 having a generally cylindrical wall providing an inner, central though passage 88 extending between a proximal or terminal end 89 and a distal end 90. The tubular body 86 has an outer surface 92 sized for a clearance fit within the through passage 14 of the insulator 12. Accordingly, an annular pocket or void 93 is provided between the outer surface 92 and the insulator 12. To facilitate retaining and fixing the central electrode assembly 19, including the first terminal 82 and the central electrode 20, in the passage 14 of the insulator 12, a seal column 94 is provided within the void 93, thereby filling or substantially filling the void and fixing the central electrode assembly 19 within the insulator 12. The seal column 94, by way of example and without limitation, can be provided by a tamped powder, glass, ceramic, or other suitable thermal conducting, but electrically insulating material. Further, the outer surface adjacent the distal end 90 is shown as being sized for a line-to-line or slightly tight fit within the through passage 79 adjacent the head 78 of the central electrode 20 to establish good electrical conductivity between the first terminal 82 and the central electrode 20. Any mechanism of attachment can be used to fix the distal end 90 of the first terminal 82 to the terminal end 75 of the central electrode, such as brazing, welding, interference fit, adhesive, or otherwise. Accordingly, the central electrode 20 acts as an extension of the first terminal 82, in this embodiment.

The firing tip 22 is shown in this embodiment as being constructed of a separate piece of material from the central electrode 20. The firing tip 22 is attached in electrical communication with the central electrode 20, and thus, with the second terminal 84 via the heater element 24. The firing tip 22 can be constructed of any suitable firing tip material having good thermal and electrical conductivity, and it can be constructed from the same or a different material as the central electrode 20. In the present embodiment, the firing tip 22 is constructed as a single, or monolithic piece of material with the first terminal 82, though they could be constructed from separate pieces of material, if desired, such as shown in FIG. 2A wherein primed numbers are used to indicated similar features discussed above, for example. Further, they could be constructed of dissimilar materials, if desired. As noted above, the firing tip 22 provides the sparking surface 36 that is spaced by the spark gap 34 from the ground electrode sparking surface 32.

The heater element 24 has an annular body with a through passage 95 sized for a clearance fit with the first terminal 82. The heater element 24 is represented, by way of example and without limitation, as having the same or substantially the same wall thickness and diameter as the tubular wall 80 of the central electrode 20. One end of the heater element 24 is attached to the distal end 76 of the central electrode 20 and the other end of the heater element 24 is attached to the outer periphery of the firing tip 22, such as by way of soldering, brazing, welding, adhesive, or other electrically conducting joining mechanism. The heater element 24 is located with in the core nose region 26, and is shown here as being substantially or immediately adjacent the core nose end 18. The heater element 24 is constructed from a material having an increased resistivity in comparison with the central electrode 20 and the firing tip 22 to ensure the heater element 24 is sufficiently heated, thereby ensuring desired electrical heating occurs in this region of the core nose region 26. For example, the resistivity believed most suitable for the heater elements 24 is within a range of about 0.75 to 20 ohm*cm, which can be provided by silicon carbide or boron carbide, for example, or similar materials, such as silicon nitride with the addition of resistance-modifiers, based on, for example, molybdenum or titanium. It is contemplated that the resistivity of the heater element 24 could be outside the above specified range by changing the geometry of the heater element 24 and/or by altering the current/voltage used.

The first terminal 82 is shown as being constructed as a single, monolithic piece of material with the firing tip 22. The first terminal 82 extends from the firing tip 22 upwardly through the through passage 95 of the heater element 24; through the through passage 79 of the central electrode 20 and through the through passage 88 of the second terminal 84 to an axially exposed terminal end 96. The first terminal 82 extends through the aforementioned through passages 95, 79, 88 in spaced relation so as to provide a void or annular space 97 extending along the entire length of the first terminal 82 to maintain the first terminal 82 out of electrical contact with the respective components 24, 20, 84. The space 97 can be filled or substantially filled with a thermally conducting, electrically insulating material to increase the thermal conductivity of the central electrode assembly 19 as a whole, such as with alumina or magnesium oxide powders, for example. Accordingly, a complete electrical circuit is established in series through the first terminal 82, then through the central electrode 20, then through the heater element 24, then through the firing tip 22, and then through the second terminal 84.

During use, a relatively low voltage power source (e.g, 12V, not shown) is attached to the terminal ends 96, 89 of the respective first and second terminals 82, 84. The flow of electricity follows the aforementioned flow path, whereupon a suitable current causes a spark to be generated across the spark gap 34. In addition, the current, such as about 10 amperes or less, for example, causes the heater element 24 to be "self heated" independently from the combustion heat whereupon the temperature of the heater element 24 is raised sufficiently in temperature to raise the temperature of the core nose region 26 of the insulator 12. As such, the exposed outer surface 28 of the core nose region 26 is heated sufficiently to inhibit contamination build-up thereon, thus inhibiting "fouling" and prolonging the useful life of the spark ignition device 10.

Figure 3:
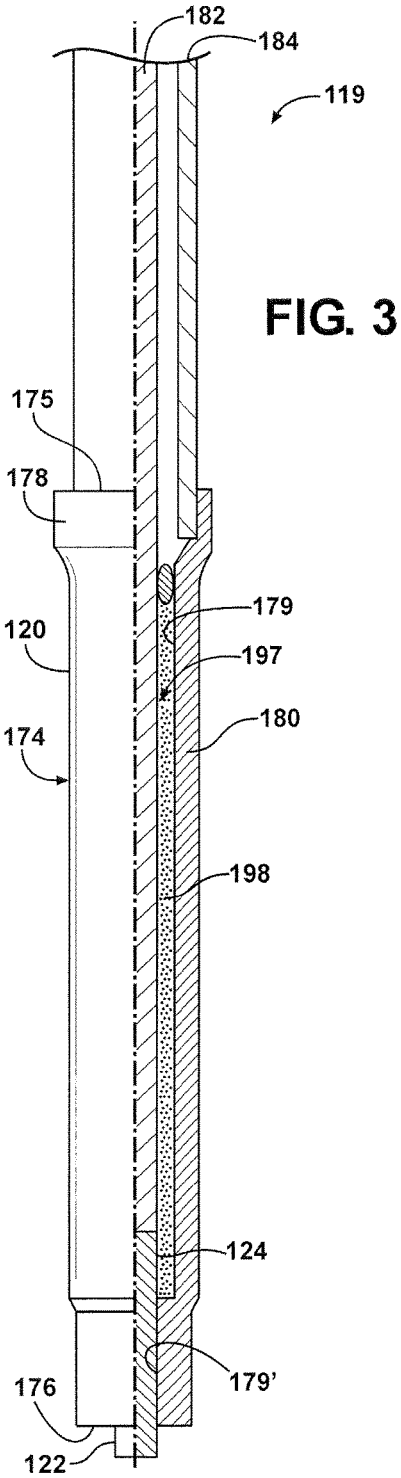
FIG. 3 is a cross-sectional elevation view of an ignition device heater element constructed in accordance with another aspect of the invention.

As shown in FIG. 3, wherein the same reference numerals as used above, offset by a factor of 100, are used to identify similar features, a central electrode assembly 119 is constructed in accordance with another aspect of the invention. The central electrode assembly 119 can be used in conjunction with the same or similar insulator 12 and shell 13 as discussed above, and thus, they are not discussed in further detail. The central electrode assembly 119 functions similarly to the electrode assembly 19 discussed above to inhibit contamination build-up on the core nose region 26 in the insulator 12, although having some structural differences in construction, which are discussed hereafter.

The central electrode assembly 119, as in the embodiment above, includes a central electrode 120, a firing tip 122, a heater element 124, a first terminal 182 and a second terminal 184. The central electrode 120 has a body with a generally cylindrical outer surface 174 extending generally between an upper terminal end 175 and a lower distal end 176. The terminal end 175 has a radially outward arcuate flair or taper to an increased diameter head 178. The body is tubular in form, and thus, has a central through passage, shown here as including an enlarged central though passage portion 179 and a reduced diameter through passage 179' portion adjacent the distal end 176 provided by an outer tubular wall 180 extending between the terminal and distal ends 175, 176.

The firing tip 122 is shown in this embodiment as being constructed of a separate piece of material from the central electrode 120, but as a single, monolithic piece of material with the heater element 124. As in the previous embodiment, the firing tip 122 is attached in electrical communication with the central electrode 120, and thus, with the second terminal 184 via the heater element 124. In this embodiment, the firing tip 122 is constructed as a separate piece of material from the first terminal 182. The firing tip 122 and the heater element 124, as shown, are constructed as a cylindrical member, though a different geometry could be used. The combination firing tip/heater element 122, 124 are sized for close receipt, such as line-to-line or slight interference fit within the reduced diameter through passage 179' of the central electrode 120. The firing tip 122 extends axially outwardly from the distal end 176 of the central electrode 120, while the heater element 124 extends axially upwardly into the enlarged diameter through passage 179 and into electrical attachment with the first terminal 182. As in the previous embodiment, a void or annular space 197 can be filled or substantially filled with a thermally conducting, electrically insulating material 198 to increase the thermal conductivity of the central electrode assembly 119 as a whole, such as with alumina or magnesium oxide powders, for example. The insulating material 198 can further be sealed in the central electrode 120 by an annular seal 99 constructed of an suitable seal material. The annular seal 99 is shown here as being adjacent the enlarged head 178, and thus, the central electrode 120 is substantially filled with the insulating material 198.

Otherwise, the central electrode assembly 119 functions generally the same in use, with a complete electrical circuit being established in series through the first terminal 182; through the heater element 124 and the firing tip 122; through the central electrode 120, and then through the second terminal 184. As such, the current causes the heater element 124 to be "self heated" during normal operating conditions to a sufficient temperature to raise the temperature of the core nose region 26 of the insulator 12. As such, the core nose region 26 is heated sufficiently to inhibit contamination build-up thereon, thus inhibiting "fouling" and prolonging the useful life of the spark ignition device containing the central electrode assembly 119.

Figure 4:
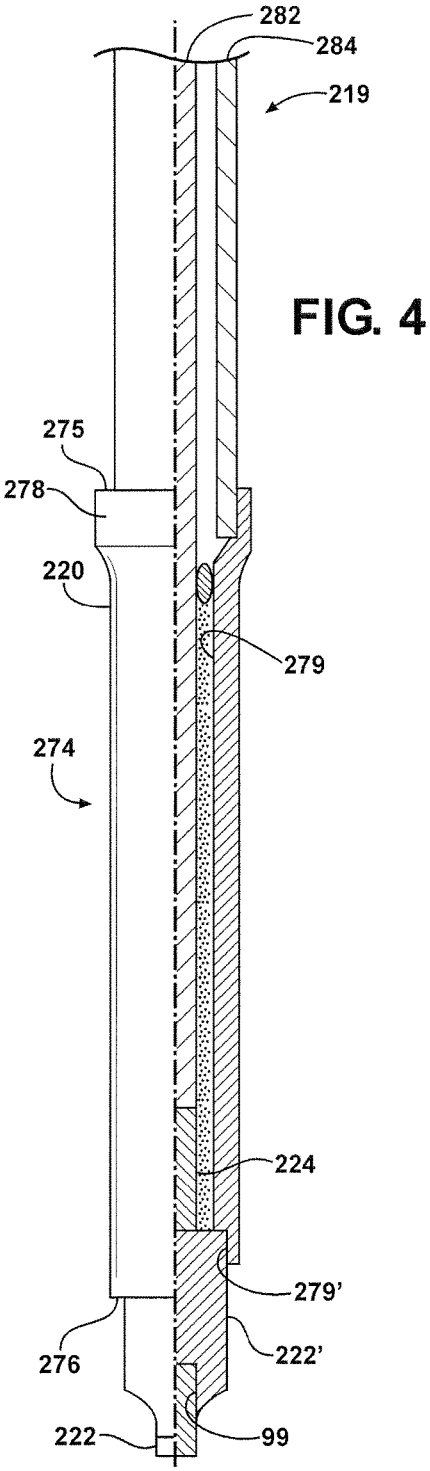
FIG. 4 is a cross-sectional elevation view of an ignition device heater element constructed in accordance with another aspect of the invention.

As shown in FIG. 4, wherein the same reference numerals as used above, offset by a factor of 200, are used to identify similar features, a central electrode assembly 219 is constructed in accordance with another aspect of the invention. The central electrode assembly 219 can be used in conjunction with the same or similar insulator 12 and shell 13 as discussed above, and thus, they are not discussed in further detail. The central electrode assembly 219 functions similarly to the electrode assembly 19 to inhibit contamination build-up on the core nose region 26 of the insulator 12, although having some structural differences in construction discussed hereafter.

The central electrode assembly 219, as in the embodiments above, includes a central electrode 220, a firing tip 222, a heater element 224, a first terminal 282 and a second terminal 284. The central electrode 220 has a body with a generally cylindrical outer surface 274 extending generally between an upper terminal end 275 and a lower distal end 276. The terminal end 275 has a radially outward arcuate flair or taper to an increased diameter head 278 to facilitate fixing the central electrode 220 in the insulator 12. The body is tubular in form, and thus, has a central through passage 279 extending between the ends 275, 276, with an enlarged diameter counterbore through passage portion 279' being formed adjacent the distal end 276.

The firing tip 222, unlike the firing tip 122 in the previous embodiment, is constructed of a separate piece of material from the heater element 224 and is spaced from the heater element by a firing tip end section 222'. The firing tip end section 222' has a proximal end configured for a close fit, such as a line-to-line or slight interference fit, within the through passage portion 279', and can be fixed therein via any suitable electrically conducting mechanism, such as via soldering, welding, brazing, or otherwise. The firing tip end section 222' extends to a distal end configured for receipt and attachment to the firing tip 222. The firing tip 222 is shown here as being fixed in a recessed pocket 99 extending into the distal end of the firing tip end section 222'. Accordingly, in this embodiment, with the firing tip end section 222' being fixed to the distal end 276 of the central electrode 220 and between the heater element 224 and the firing tip 222, and with the heater element 224 being received in sealed fashion within the through passage 279 of the central electrode 220, the heater element 224 is not exposed to combustion gases or any potential erosion from spark. Further, the heater element 224 can be constructed using any suitable material, whether different or the same material used to construct the firing tip 222.

Otherwise, the central electrode assembly 119 is constructed generally the same as described and illustrated for the central electrode assembly 120, and thus, functions generally the same in use, with a complete electrical series circuit being established through the first terminal 282; through the heater element 224; through the firing tip 222', 222, through the central electrode 220, then through the second terminal 284. As such, the current causes the heater element 224 to be "self heated" without use of a separate power source as used to generate the spark during normal operating conditions. And, as with the previous embodiments, with the heater element 224 disposed within the core nose region 26, the core nose region 26 is heated sufficiently to inhibit contamination build-up thereon, thus inhibiting "fouling" and prolonging the useful life of the spark ignition device containing the central electrode assembly 219.

Figure 5:
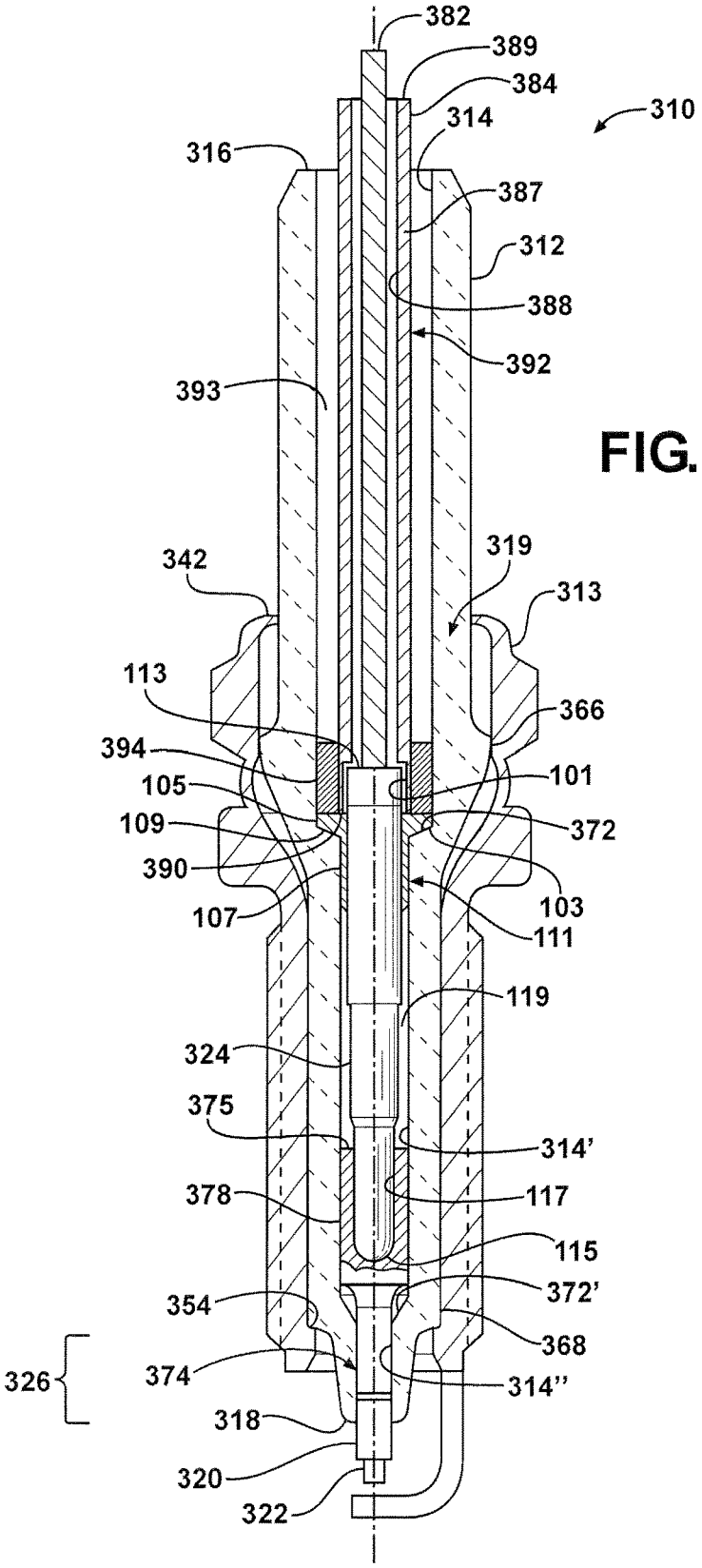
FIG. 5 is a cross-sectional elevation view of an ignition device having a heater element constructed in accordance with yet another aspect of the invention.

As shown in FIG. 5, wherein the same, reference numerals as used above, offset by a factor of 300, are used to identify similar features, a spark ignition device 310 is constructed in accordance with another aspect of the invention.

The spark ignition device 310 of FIG. 5, similarly as described and illustrated with regard to FIG. 2, includes an insulator 312 and an outer metal shell 313 receiving, at least in part, the insulator 312 therein. Further, as described above in the preceding embodiments, a central electrode assembly 319 constructed in accordance with another aspect of the invention is received, at least in part, in the insulator 312. The geometry of the metal shell 313 and the insulator 312 are similar to that described and illustrated in FIG. 2, though some structural differences exist, which will be apparent to one of ordinary skill in the art. That said, it should be recognized that the geometries of the metal shell 313 and the insulator 312 can be altered to accommodate a central electrode assembly constructed in accordance with the invention.

The insulator 312 has a through passage 314 extending between a terminal or upper end 316 and a distal or core nose end 318. The through passage 314 is represented here as having an enlarged diameter upper region, a mid-region 314' reduced in diameter from the upper region, and a lowermost region 314" reduced in diameter from the mid-region 314', with each region 314, 314', 314" being cylindrical or substantially cylindrical. As such, the insulator 312 has an upper, radially inwardly extending shoulder 372 between the upper through passage region 314 and the mid-region 314' and a lower shoulder 372' extending between the mid-region 314' and the lowermost region 314". Further, the insulator 312 has an outer shoulder 366 configured to be operably captured by a curled over terminal end 342 of the shell 313, wherein a packing material can be received between the terminal end 342 and the upper shoulder 366, and further, a lower shoulder 368 that confronts a lower flange 354 of the shell 313. A gasket (not shown), such as shown in FIG. 2, can be sandwiched between the lower shoulder 368 and the lower flange 354 to facilitate establishing a seal there between, if desired.

As in the embodiments above, the central electrode assembly 319 includes a central electrode 320, a firing tip 322, a heater element 324, a first terminal 382 and a second terminal 384. The second terminal 384 has a generally cylindrical wall 387 providing an inner, central though passage 388 extending between a proximal or terminal end 389 and a distal end 390. The cylindrical, wall 387 has an outer surface 392 sized for a clearance fit within the upper region of the insulator through passage 314. Accordingly, an annular pocket or void 393 is provided between the outer surface 392 and the insulator 312. Further, the distal end 390 has a counterbore 101 enlarged in diameter from the through passage 388.

The counterbore 101 is sized for a clearance fit about the heater element 324, but is configured for electrical communication with the heater element 324 via an annular collar 103. The collar 103 is generally T-shaped in axial cross-section, having an enlarged diameter head portion 105 sized for close receipt in the through passage 314 of the insulator 312 and a reduced diameter portion 107 depending from the head portion 105 for close receipt in the mid-region 314' of the insulator 312. Accordingly, the collar 103 has a shoulder 109 configured for abutment with the shoulder 372 extending between the respective regions 314, 314' of the insulator. The reduced diameter portion 107 has an annular, cylindrical wall with an outer surface 111 sized for a close, line-to-line or slight interference fit within the mid-region 314' of the insulator 312 and an inner surface sized for a close, line-to-line or slight interference fit with the outer surface of the heater element 324. As such, the collar 103 establishes electrical contact with an outer surface of the heater element 324, and acts to fix the heater element 324 and the central electrode assembly 319 within the insulator 312.

To further facilitate retaining the central electrode assembly 319 in the passage 314 of the insulator 312, a seal or seal column 394 is provided within the void 393, thereby at least partially filling the void 393 and fixing the central electrode assembly 319 within the insulator 312. The seal column 394, by way of example and without limitation, can be provided by a tamped powder, metal, glass, ceramic, or other suitable thermal conducting, but electrically insulating material.

The heater element 324 has an elongate body extending substantially through the mid-region 314' of the insulator 312. The body has one end 113 received in a clearance fit within the counterbore 101 of the first terminal 382, and thus, out of direct electrical contact therewith, and being attached in direct electrical communication with the first terminal 382, such as by way of soldering, brazing, welding, adhesive, or other electrically conducting joining mechanism. The heater element 324 extends to another end 115 generally adjacent a core nose region 326 of the insulator 312. The end 115 is configured for attachment to an upper terminal end 375 of the central electrode 320, with the terminal end 375 having an increased diameter head 378 within the mid-region 314' of the insulator 312. The annular head 378 facilitates seating and sealing the terminal end 375 against the shoulder 372' of the insulator 312. The end 115 is shown here as being received and fixed in a recessed pocket 117 extending into the head 378 of the central electrode 320.

The central electrode 320 has a reduced diameter outer surface 374 depending from the enlarged head 378. The reduced diameter surface 374 is sized for a close fit within the core nose region 326 and extends axially outwardly from the core nose region 326 to the firing tip 322.

In use, the relatively low voltage is applied to the first and second terminals 382, 384, whereupon the current flows through the first terminal 382 to the collar 103 through to the outer electrical contact on the outer surface of the heater element 324. The current is able to complete a series circuit by flowing back through the second terminal 384. The current flowing through the heater element 324 generates heat mostly in the joint region formed between the end 115 and the pocket 117. The heat generated within the joint region is predominantly transferred to the central electrode 320. An annular gap 119 around the heater element 324 forms a thermal barrier between the heater element 324 and the insulator 312, except within the core nose region 326 where the gap is minimized. Accordingly, heat flows within the core nose region 326 where it causes a temperature rise, wherein the temperature is maintained in an optimal temperature range, such as between about 350-400° C. As such, cold start performance is improved as a result of heat being transferred to the core nose region 326 of the insulator 312 before and during the starting operation. This can prevent ignition failure by inhibiting "fouling" by unburned fuel and combustion deposits/contamination. In addition to the heat being generated via a low voltage source, a high voltage source can be applied via the first and/or second terminals 382, 384 to generate a spark across the spark gap 334.

As shown in FIG. 6, wherein the same reference numerals as used above, offset by a factor of 400 and/or primed, are used to identify similar features, a spark ignition device 410 is constructed in accordance with another aspect of the invention.

The spark ignition device 410 of FIG. 6, similarly as described and illustrated with regard to FIG. 5, includes an insulator 412 and an outer metal shell 413 receiving, at least in part, the insulator 412 therein. Further, as described above in the preceding embodiments, a central electrode assembly 419 constructed in accordance with another aspect of the invention is received, at least in part, in the insulator 312.

The insulator 412 has a through passage 414 extending between a terminal or upper end 416 and a distal or core nose end 418. The through passage 414 is represented here as having an enlarged diameter upper region, a mid-region 414' reduced in diameter from the upper region, and a lowermost region 414" reduced in diameter from the mid-region 414', with each region 414, 414', 414" being cylindrical or substantially cylindrical. As such, the insulator 412 has an upper, radially inwardly extending shoulder 472 between the upper through passage region 414 and the mid-region 414' and a lower shoulder 472' extending between the mid-region 472' and the lowermost region 414". Further, the insulator 412 has an outer shoulder 466 configured to be operably captured by a curled over terminal end 442 of the shell 413, wherein a packing material can be received between the terminal end 442 and the upper shoulder 466, and further, a lower shoulder 468 that confronts a lower flange 454 of the shell 413. A gasket (not shown) can be sandwiched between the lower shoulder 468 and the lower flange 454 to facilitate establishing a seal there between, if desired.

As in the embodiments above, the central electrode assembly 419 includes a heater element 424, a first terminal 482 and a second terminal 484. The second terminal 484 has a generally cylindrical wall 487 providing an inner, central through passage 488 extending between a proximal or terminal end 489 and a distal end 490. The cylindrical wall 487 has an outer surface 492 sized for a close fit within the upper region of the insulator through passage 414, with the through passage 488 adjacent the distal end 490 being sized for a close fit in electrical communication with an enlarged diameter upper end 113' of the heater element 424. The distal end 490 of the wall 487 is spaced axially from the reduced diameter mid-region 414' of the insulator 412, and thus, an annular space or void 493 is provided around the heater element 424, wherein the void 493 forms a thermal barrier between the heater element 424 and the insulator 412.

The heater element 424, as with in the embodiment shown in FIG. 5, extends to a slightly reduced diameter distal end 115' sized for close receipt completely through the core nose region 426 of the insulator 412 to a firing tip 422 adjacent a ground electrode 430. A sparking surface 436 of the firing tip 422 is provided on a side surface of the heater element 424 facing laterally toward a free end sparking surface 432 of the ground electrode 430. Otherwise, as shown in FIG. 6A, an intermediate material can be attached to the distal end 115' of the heater element 424, wherein the intermediate material acts to provide the firing tip 422'. Accordingly, the heater element 424 doubles as a heating mechanism to inhibit build up of contamination on an external surface of the core nose region 426 while also functioning as the firing tip 422. With the heater element 424 passing in close, minimal clearance relation through the entire length of the core nose region 426, the core nose region 426 is assured of being adequately heated in use to facilitate cold starts as well as to prevent "fouling" of the spark ignition device 410.

To maintain the central electrode assembly 419 in a predetermined fixed position within the insulator 412, a collar 103' in combination with an annular seal or seal column 494 is provided within the void 493, thereby at least partially filling the void 493 and fixing the central electrode assembly 419 within the insulator 412. The seal column 494 is shown as being formed about an outer periphery of the collar 103' to fill the void 493 between the outer periphery of the collar 103' and the insulator 412. Further, the seal column 494 also extends axially upwardly from the collar 103' to further seal at least a portion of the void 493 between the heater element 424 and the insulator 412. As such, the collar 103' is firmly fixed in place along with the heater element 424. To further facilitate fixing the heater element 424 against lateral movement, the collar 103' has a reduced diameter end portion EP received in part within a counterbore CB extending into the mid-region 414' of the insulator 412. The end portion EP, aside from providing added retention of the heater element 424, provides a self-centering mechanism to the heater element 424. The seal column 494, by way of example and without limitation, can be provided by a tamped powder, metal, glass, ceramic, or other suitable thermal conducting, but electrically insulating material.

Figure 7:
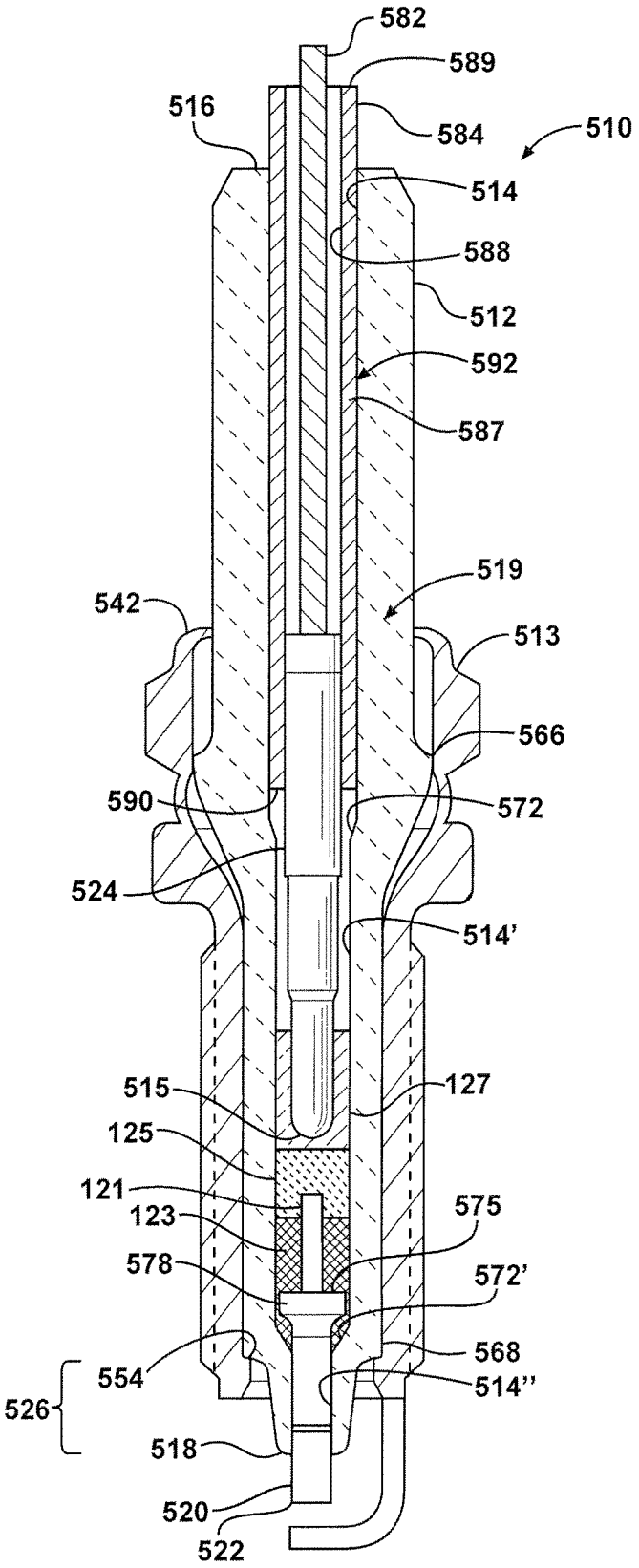
FIG. 7 is a cross-sectional elevation view of an ignition device having a heater element constructed in accordance with yet another aspect of the invention.

As shown in FIG. 7, wherein the same reference numerals as used above, offset by a factor of 500 and/or double primed, are used to identify similar features, a spark ignition device 510 is constructed in accordance with another aspect of the invention.

The spark ignition device 510 of FIG. 7, similarly as described and illustrated with regard to FIG. 5, includes an insulator 512 and an outer metal shell 513 receiving, at least in part, the insulator 512 therein. Further, as described above in the preceding embodiments, a central electrode assembly 519 constructed in accordance with another aspect of the invention is received, at least in part, in the insulator 512.

The insulator 512 has a through passage 514 extending between a terminal or upper end 516 and a distal or core nose end 518. The through passage 514 is represented here as having an enlarged diameter upper region, a mid-region 514' reduced in diameter from the upper region, and a lowermost region 514" reduced in diameter from the mid-region 514'. As such, the insulator 512 has an upper, radially inwardly extending shoulder 572 between the upper through passage region 514 and the mid-region 514' and a lower shoulder 572' extending between the mid-region 514' and the lowermost region 514". Further, the insulator 512 has an outer shoulder 566 configured to be operably captured by a curled over terminal end 542 of the shell 513, and further, a lower shoulder 568 that confronts a lower flange 554 of the shell 513.

As in the embodiments of FIG. 5, the central electrode assembly 519 includes a central electrode 520, a firing tip 522, a heater element 524, a first terminal 582 and a second terminal 584. The second terminal 584 has a generally cylindrical wall 587 providing an inner, central though passage 588 extending between a proximal or terminal end 589 and a distal end 590. The cylindrical wall 587 has an outer surface 592 sized for a close or line-to-line fit within the upper region of the insulator through passage 514, unlike the embodiment of FIG. 5 wherein a void is established.

The through passage 588 is sized for a close or line-to-line fit about the heater element 324, but thus, is configured for electrical communication with an outer surface of the heater element 324. As such, the second terminal 584 facilitates maintaining the heater element 524 in a fixed position within the insulator 512.

The heater element 524 has an upper portion extending within the enlarged region of the insulator through passage 514 into the through passage 588 of the second terminal 584 and a lower portion extending into the reduced diameter portion of the insulator through passage 514'. The lower portion of the heater element 524 is received in a clearance fit within the through passage 514' and extends therein to a free end 515. The end 515 is configured for electrical communication with an upper terminal end 575 of the central electrode 520, with the terminal end 575 having a backing wire 121 extending axially outwardly therefrom toward the heater element 524. A seal element 123 can be disposed about the backing wire 121 and about an enlarged head 578 of the central electrode 520 to facilitate maintaining them fixed within the insulator 512. The seal element 123 can be electrically conductive, if desired. An electrical transfer member 125 is also provided in electrical communication with the seal element 123. The electrical transfer member 125 is shown formed about a terminal end of the backing wire 121 and extending upwardly to a terminal interface 127. The terminal interface is formed about the distal free end 515 of the heater element 524 and acts to transfer electrical and thermal energy from the heater element 524 into the central electrode 520. Accordingly, it should be recognized that electrical and thermal energy are freely transferred from the heater element 524 through the terminal interface 127, through the electrical transfer member 125 and through the seal element 123 to the backing wire 121.

In use, the spark ignition device 510 functions similarly to the spark ignition device 310 of FIG. 5, however, the heat generated by the heater element 524, rather than being immediately adjacent a core nose region 526 of the insulator 512, is transferred axially downwardly through the thermal interface 127, the transfer element 125, the seal element 123 and the central electrode 520 to the core nose region 526. Rather than forming a multi-component seal including the separate thermal interface 127, transfer element 125 and the seal element 123, one or more of the multi-component members my be combined, e.g., the thermal interface 127 and the transfer element 125 can be formed as a single component.

Figure 8:
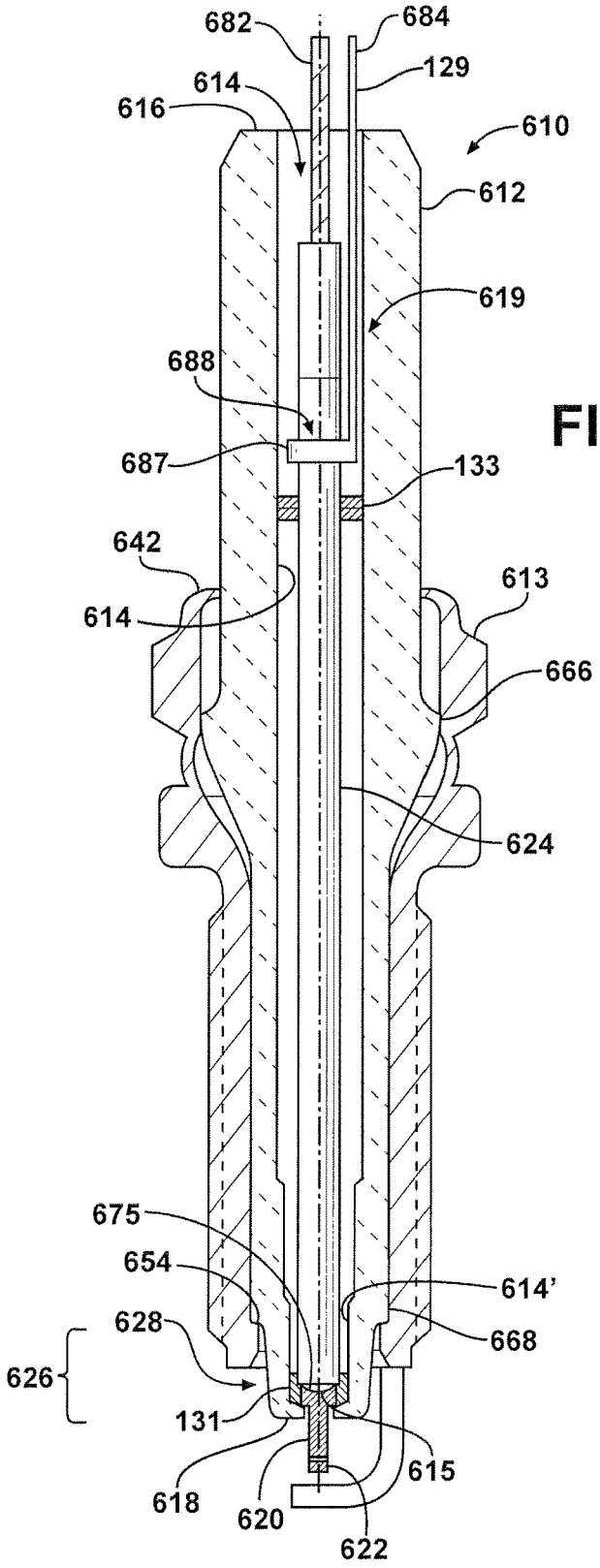
FIG. 8 is a cross-sectional elevation view of an ignition device having a heater element constructed in accordance with yet another aspect of the invention.

As shown in FIG. 8, wherein the same reference numerals as used above, offset by a factor of 600, are used to identify similar features, a spark ignition device 610 is constructed in accordance with another aspect of the invention.

The spark ignition device 610 of FIG. 8 includes an insulator 612 and an outer metal shell 613 receiving, at least in part, the insulator 612 therein. Further, as described above in the preceding embodiments, a central electrode assembly 619 constructed in accordance with another aspect of the invention is received, at least in part, in the insulator 612.

The insulator 612 has a through passage 614 extending between a terminal or upper end 616 and a distal or core nose end 618. The insulator 612 has an outer shoulder 666 configured to be operably captured by a curled over terminal end 642 of the shell 613, and further, a lower shoulder 668 that confronts a lower flange 654 of the shell 613.

The central electrode assembly 619 includes a central electrode 620, a firing tip 622, a heater element 624, a first terminal 682 and a second terminal 684. The second terminal 684 has a generally cylindrical wall 687 providing an inner, central though passage 688. The through passage 688 is sized for receipt of the heater element 624 therein, wherein upon the cylindrical wall 687 is brought into electrical communication with an outer surface of the heater element 624. The second terminal 684, including the cylindrical wall 687, is sized for a clearance fit within the upper region of the insulator through passage 514. The second terminal 684 is represented, by way of example, as having an elongate terminal connector 129 extending upwardly from the cylindrical wall 687 outwardly from the terminal end 616 of the insulator 612, with the terminal connector 129 remaining out of contact with the insulator 612.

The heater element 624 has an upper portion extending within the enlarged region of the insulator through passage 614 adjacent to the terminal end 616 of the insulator 612 and a lower portion extending into a reduced diameter through passage 614' of a nose core region 626 of the insulator 612. The heater element 624 is shown having a cylindrical or substantially cylindrical outer surface of a constant or substantially constant diameter over its full length. The outer surface of the heater element 624 is sized for a clearance fit along its entire length through the through passage 614, 614', however, with a reduced annular gap being formed between the heater element 624 and the insulator 620 in the nose core region 626. The lower portion of the heater element 624 terminates at a free end 615 that is attached in electrical communication with a terminal end 675 of the central electrode 620 in the nose core region 626. The joint between the free end 615 and the terminal end 675 is made using a thermally and electrically conducting mechanism 131 sufficient to maintain the heater element 624 in its fixed or substantially fixed position, such as a resinous material, for example. Being both thermally and electrically conductive, the heat generated in the region of the free end 615 and within the core nose region 626 is transferred to the core nose region 626 of the insulator. As such, an outer surface 628 of the core nose region 626 is heated, wherein the temperature is maintained within an optimal temperature range, thereby inhibiting "fouling" by unburned fuel and combustion deposits/contamination and facilitating cold start operation. If desired, an additional support element 133 can be disposed between the heater element 624 and the insulator 612 within the through passage 614 to further fix the heater element 624. The support element 133 is preferably provide as a flexible or semi-flexible member to facilitate dampening any vibration that may be transmitted through the ignition spark device 610 and to allow expansion and contraction of the heater element 624 in use.

Obviously, many modifications and variations of the present invention are possible in light of the above teachings. It is, therefore, to be understood that within the scope of the appended claims, the invention may be practiced otherwise than as specifically described. Accordingly, the invention is ultimately defined by the scope of any allowed claims, and not solely by the exemplary embodiments discussed above.

What is claimed is:

1. A spark ignition device, comprising:

a tubular ceramic insulator extending along a central axis;

a metal shell surrounding at least a portion of said ceramic insulator;

a ground electrode operatively attached to said shell, said ground electrode having a ground electrode sparking tip;

a central sparking tip, said central sparking tip and said ground electrode sparking tip providing a spark gap;

a first terminal extending coaxially along said central axis and arranged in electrical communication with said central sparking tip and configured for electrical connection with a power source;

a second terminal spaced radially outwardly from said first terminal and arranged in electrical communication with said first terminal and configured for electrical connection with the power source; and a heater element spaced radially outwardly from said first terminal and bringing said first terminal in electrical communication with said second terminal and completing an electrical circuit between said first and second terminals, said heater element having a resistance greater than said first and second terminals;

a central electrode separate from said first terminal and said second terminal, said central electrode having an elongate body extending along said central axis to a free end, said heater element being configured as an annular ring extending about said central axis and disposed between said free end of said central electrode and said central sparking tip;

said first terminal extending substantially through said central electrode along said central axis and being adjacent said central sparking tip; and said heater element extending between opposite ends with said first terminal being attached to one of said ends.

2. The spark ignition device of claim 1 wherein an end of said heater element opposite said first terminal forms said central sparking tip.

3. The spark ignition device of claim 1 wherein an end of said heater element opposite said first terminal is operably attached to said central sparking tip.

4. The spark ignition device of claim 1 wherein said firing tip is constructed as a monolithic piece of material with said first terminal.

5. The spark ignition device of claim 1 wherein said heater element is completely spaced from said central axis.

6. A central electrode assembly for a spark ignition device, comprising:

a first terminal configured for electrical connection with a power source;

a second terminal spaced from said first terminal and arranged in electrical communication with said first terminal and configured for electrical connection with the power source;

a central electrode separate from said first terminal and said second terminal, said central electrode having an elongate body extending along a central axis, said central electrode having a pocket extending along said center axis and including a firing tip having a sparking surface;

a heater element being received at least in part in said pocket of said central electrode, and said heater element bringing said first terminal in electrical communication with said second terminal and completing an electrical circuit between said first and second terminals; and a shell electrically insulated from the center electrode and spaced from said sparking surface of said firing tip across a spark gap for operatively initiating a spark between said sparking surface across said gap when in use.

7. The central electrode assembly of claim 6 wherein said first terminal extends along said central axis and said second terminal is spaced radially outwardly from said first terminal.

8. The central electrode assembly of claim 7 wherein said heater element is disposed radially outwardly relative to said first terminal.

9. The central electrode assembly of claim 6 wherein said heater element extends between opposite ends with said first terminal being attached to one of said ends.

10. The central electrode assembly of claim 6 wherein an end of said heater element opposite said first terminal forms a central sparking tip.

11. The central electrode assembly of claim 6 wherein said elongate body of said central electrode extends from a head to a base end, said pocket extends into said head of said elongate body, and said firing tip is disposed at said base end.

* * * * *